United States Patent [19]

Denison

[11] 4,121,193

[45] Oct. 17, 1978

[54] KELLY AND KELLY COCK ASSEMBLY FOR HARD-WIRED TELEMETRY SYSTEM

[75] Inventor: Early B. Denison, Houston, Tex.

[73] Assignee: Shell Oil Company, Houston, Tex.

[21] Appl. No.: 809,259

[22] Filed: Jun. 23, 1977

[51] Int. Cl.[2] ..... G01V 1/40; H01R 3/04

[52] U.S. Cl. ..... 340/18 CM; 174/47; 339/16 R; 340/18 LD

[58] Field of Search ..... 174/47; 339/15, 16 R, 339/94; 340/18 LD, 18 CM, 320; 33/312

[56] References Cited

U.S. PATENT DOCUMENTS

| | | | |
|---|---|---|---|
| 2,178,931 | 11/1939 | Crites et al. | 174/47 |
| 2,196,314 | 4/1940 | Lee | 339/16 R |
| 2,906,502 | 9/1959 | Smith | 174/47 |
| 3,170,137 | 2/1965 | Brandt | 174/47 |
| 3,696,332 | 10/1972 | Dickson et al. | 174/47 |
| 3,829,816 | 8/1974 | Barry et al. | 339/16 R |
| 3,879,097 | 4/1975 | Oertle | 340/18 LD |
| 3,989,330 | 11/1976 | Cullen et al. | 339/16 R |

*Primary Examiner*—Nelson Moskowitz

[57] ABSTRACT

A combination saver sub, kelly and lower kelly cock for use with a drill string having a hard wired telemetering system installed therein. The combination includes a hard wired circuit for extending the circuit from the top of the drill pipe to a slip ring assembly mounted on the kelly.

8 Claims, 5 Drawing Figures

KELLY AND KELLY COCK ASSEMBLY FOR HARD-WIRED TELEMETRY SYSTEM

BACKGROUND OF THE INVENTION

The present invention relates to telemetering systems, and particularly to telemetering systems designed to transmit information from the bottom of a borehole to the surface while drilling the borehole. The present invention is particularly useful in hard wired telemetering system in which the data transmission length from the bottom of the well to the surface consists of a hard wired electrical circuit. A system of this type is disclosed in U.S. Pat. No. 3,696,332. The hard wired system described in this patent utilizes special drill pipe in which each section of the drill pipe is provided with an electrical conductor that extends through the section. Special contact rings are imbedded in the sealing shoulders of the tool joints at each end of the section. Thus, when the drill pipe sections are joined, the mechanical and electrical connections are made simultaneously, and the electrical circuit is completely isolated from both the interior and exterior of the drill pipe. While the patent discloses a special drill pipe that can be used to transmit data from the bottom of the well to the surface of the well while the well is being drilled, it does not disclose a means for continuing the electrical circuit through the surface. Normally, the surface equipment will comprise a saver sub, a lower kelly cock, a kelly and an upper kelly cock, all of which is suspended from the swivel of the drill rig.

The present invention is directed to providing a means for extending the circuit formed by the specialized drill pipe of the above patent through the surface equipment to slip rings disposed on the upper end of the kelly, upper kelly cock, or swivel sub. U.S. Pat. No. 3,989,330 discloses a means for extending an electrical circuit through a kelly cock assembly. This patent discloses an electrical circuit which is formed by a conductor placed to one side of the kelly cock which terminates in contacts that are centered in the ends of the kelly cock body. While this is one possible means for extending an electrical circuit through a kelly cock, it has a serious disadvantage in that the electrical conductor and contacts are not isolated from the fluid in the interior of the kelly cock. Thus, the electrical circuit is exposed to the drilling fluids which flow through the kelly cock and the possibility of damage to the electrical circuit exists.

In addition, U.S. Pat. No. 4,016,943 discloses an apparatus similar to that disclosed in U.S. Pat. No. 3,989,330 for extending a circuit through a kelly. The system disclosed comprises a conductor disposed in the center of the bore of the kelly and exposed to the drilling mud. The connector at the ends of the conductor are positioned in the ends of the kelly and serve to connect the conductor to the other equipment. When the necessity to run wireline tools through the drill string arises, the connector and conductor must be removed. Once removed, they cannot be reinstalled until the drill string is removed from the borehole.

BRIEF SUMMARY OF THE INVENTION

The present invention solves the above problem of extending the electrical circuit through the surface equipment by utilizing the contact ring assemblies disclosed in the U.S. Pat. No. 3,696,332. The contact ring assemblies are disposed in the sealing shoulders of the various items of the surface equipment while an electrical conductor extends through the equipment and is connected to the contact rings at each end of the individual items. In particular, the circuit is extended through the saver sub by utilizing contact rings disposed in the sealing shoulders at each end of the saver sub. A conduit extends through the bore of the saver sub, and is anchored and sealed in a port at each end of the sub. An electrical conductor is placed in the conduit and joined to the contact rings in the shoulders of the sub.

The circuit is extended through the kelly cock by placing contact rings in the sealing shoulders of the two kelly cock sub assemblies, and then connecting the sealing shoulders by a long bore extending through the tubular wall of the sub assemblies. At an intermediate position along the bore, a port or opening is formed in the outer wall of the sub assemblies so that the pigtails from each of the contact rings can be joined to complete the circuit.

The circuit is then extended through the kelly by the use of a contact ring positioned in the shoulder at the lower end of the kelly and a conduit that extends through the bore of the kelly. The ends of the conduit are anchored at the upper and lower ends of the kelly by suitable means. The pigtail on the contact ring is joined to a conductor disposed in the conduit with the conductor extending out the upper port in the kelly where it is coupled to a slip ring assembly mounted on the upper end of the kelly.

The above construction provides a means by which the hard wired electrical circuit can be extended through the surface equipment while maintaining the isolation or sealing of the hard wired circuit from both the interior and exterior of the tubular members. Thus, at no time will the electrical circuit be exposed to the flowing mud stream.

BRIEF DESCRIPTION OF THE DRAWINGS

The present invention will be more easily understood by the following detailed description of the preferred embodiment when taken in conjunction with the attached drawings in which.

PREFERRED EMBODIMENT

Figure 1:
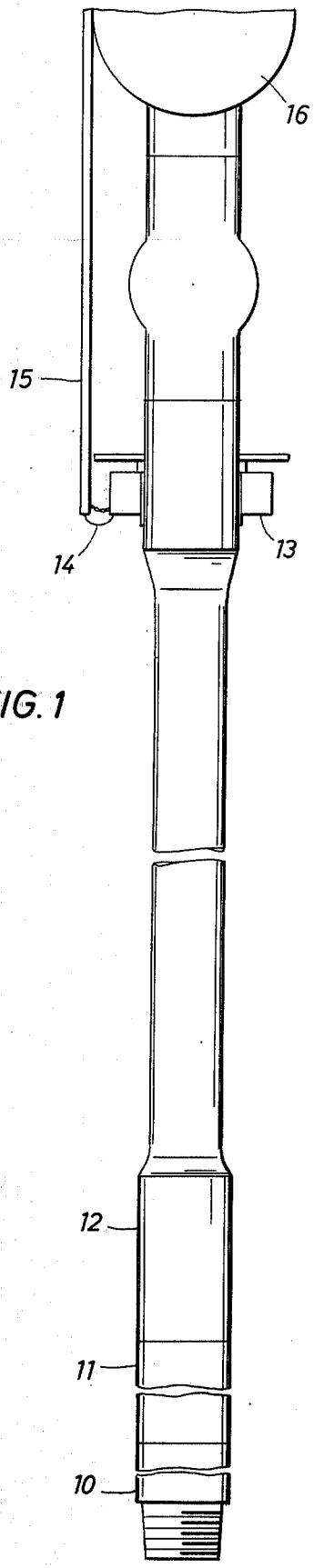
FIG. 1 is an elevation view of the saver sub, kelly cock, and kelly.

Referring to FIG. 1, there is shown the complete surface assembly comprising the saver sub 10, the kelly cock 11, the kelly 12, and the slip ring assembly 13. The slip ring assembly is connected to a cable 14 which extends up an arm 15 secured to the swivel 16. As explained above, the saver sub is provided with a contact ring in its lower sealing shoulder which mates with a similar ring in the drill pipe, not shown in FIG. 1. The circuit is continued through the saver sub by means of a conduit containing an electrical cable to a contact ring in its upper sealing shoulder which mates with a similar contact ring in the modified kelly cock. The circuit then extends through the kelly cock by means of a cable disposed in a passageway formed in the wall of the kelly cock to intermediate contact rings and on to an upper contact ring, which mates with a similar contact ring in the kelly 12. The circuit is extended through the kelly by an electrical cable disposed in a conduit placed in the interior of the kelly which terminates in the slip ring assembly 13 at the top of the kelly.

Figure 2:
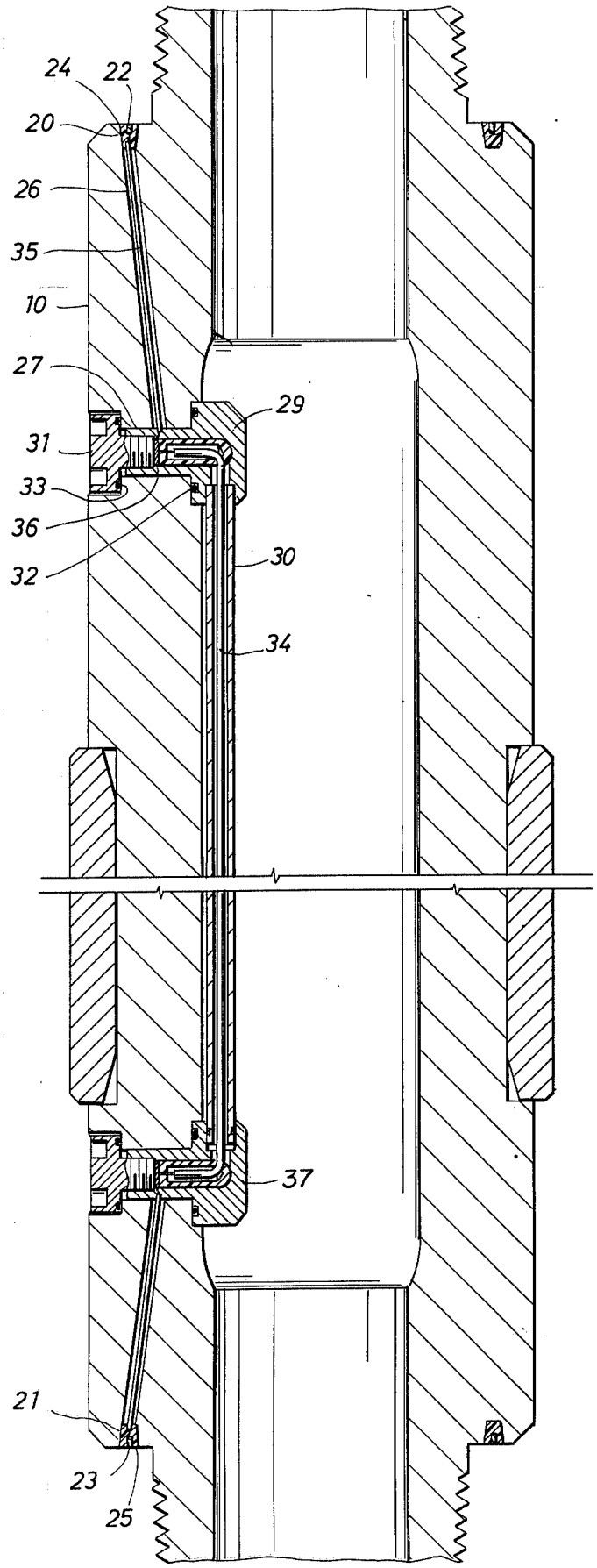
FIG. 2 is an elevation view showing a section of the saver sub.

Referring now to FIG. 2, there is shown a modified saver sub which extends the electrical circuit from the drill string to the modified kelly cock. In addition to the other modifications, the saver sub is also provided with pin joints at both ends instead of the more conventional pin and box joints since the modified kelly used in the present invention is provided box joints at both ends. The saver sub is provided with annular grooves 20 and 21 in the sealing shoulders at each end with contact rings 22 and 23, and insulation rings 24 and 25 being installed therein. Since the means used for completing the electrical circuit between the contact rings is the same at both ends of the saver sub, only the upper end of the saver sub will be described in detail, the lower end being identical thereto. The annular groove 20 communicates with a port 27 by means of a passageway 26 formed in the body of the saver sub. A conduit anchoring and sealing means 29 is mounted in the port 27 with the conduit 30 being secured to the anchoring means 29 by welding or silver brazing. The conduit extends through the saver sub to a similar anchoring-sealing means at the opposite end of the saver sub. The second anchoring and sealing means 37 is not silver brazed to the conduit 30. The parts are machined for a slip fit with an O-ring groove cut in the conduit to facilitate a seal. This allows the saver sub to stretch without stressing the conduit and also simplifies assembly. The anchoring means 29 is secured in the port by means of a cap screw 31 which threads into the ends of the anchoring means, and serves to draw it tightly into position in the saver sub port 27. O-rings 32 and 33 are used to insure a fluid-tight seal between the anchoring means and the saver sub and the screw 31 and the saver sub. Suitable insulated electrical conductor 34 extends through the conduit and into the hollow interior of the anchoring means while an insulated pigtail 35 extends from the contact ring 22 to the same hollow interior. The conductor 34 and pigtail 35 are joined together at 36 to complete the electrical connection between the two contact rings. Plastic or Teflon inserts are positioned in the port to insure that shorts do not occur between the wire splices and the saver sub body.

Figure 3:
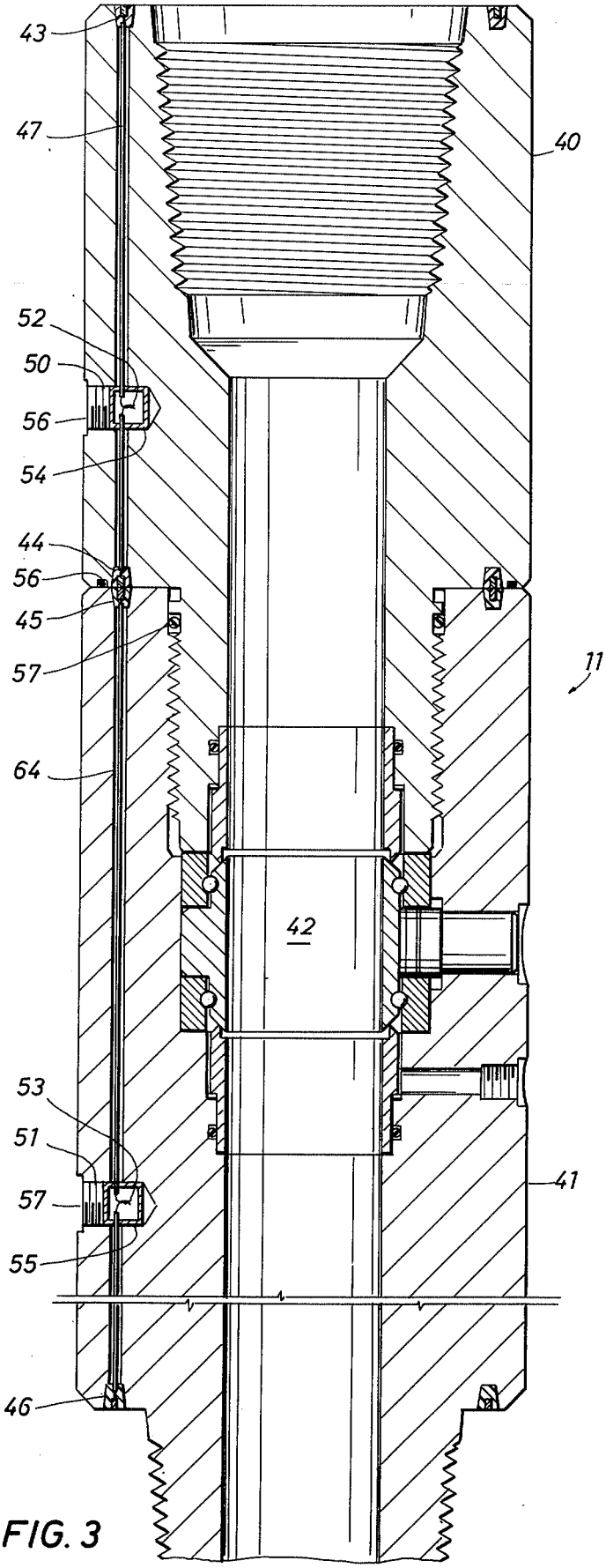
FIG. 3 is an elevation view showing a section of the modified kelly cock.

The modified kelly cock is shown in FIG. 3, and comprises two tubular members 40 and 41 which thread together to anchor the ball valve 42 in position. The ball valve may be modified Hydril 3½ inch MSP 5000 with a 2¼ inch inside diameter, manufactured by the Hydril Company of Houston, Texas. The electrical circuit is completed through the sub. Thus, suitable annular grooves 43, 44, 45 and 46 are formed in the mating sealing shoulders of the kelly cock assembly with contact rings being disposed therein. Suitable passageways 47 and 48 are formed in the tubular members 40 and 41 to provide communication between the various annular grooves. The pigtails from the various contact rings extend through the passageways and are connected together in suitable port openings 50 and 51. The pigtails are joined at 52 and 53, while suitable plastic or Teflon covers 54 and 55 are positioned in the ports to insure that shorts do not occur between the pigtails and the kelly cock body. The ports are closed by sealing plugs 56 and 57, respectively. In order to insure a fluid-tight seal between the mating shoulders of the two tubular members 40 and 41, O-rings 56 and 57 are disposed on opposite sides of the annular grooves 44 and 45. O-rings 57 is standard and O-ring 56 has been added to the modified assembly. This is required since the tubular members are used to lock the kelly cock in position, and their mating shoulders do not seal.

Figure 4:
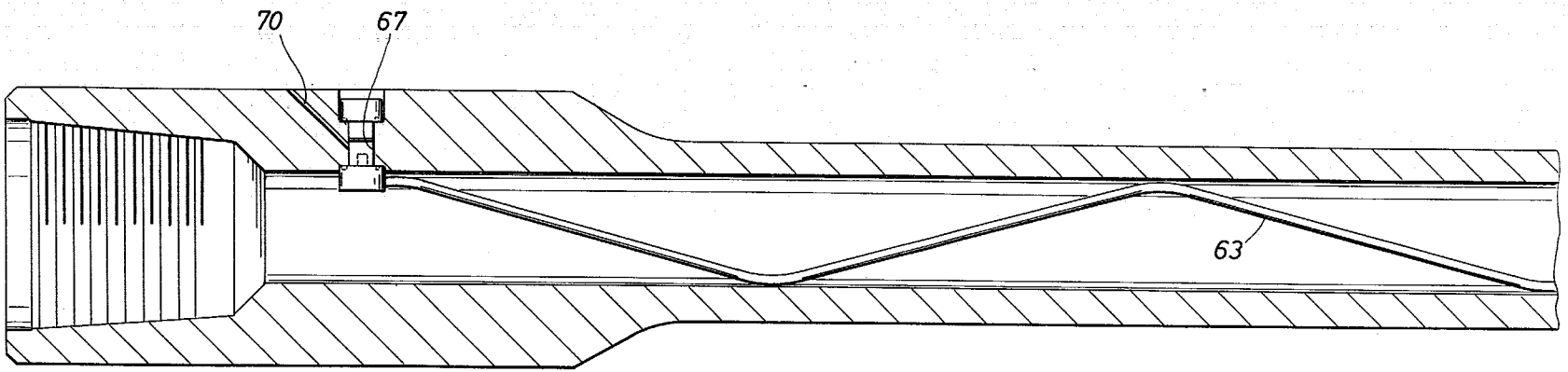
FIGS. 4 and 5 are an elevation view showing a section of the modified kelly.
Figure 5:
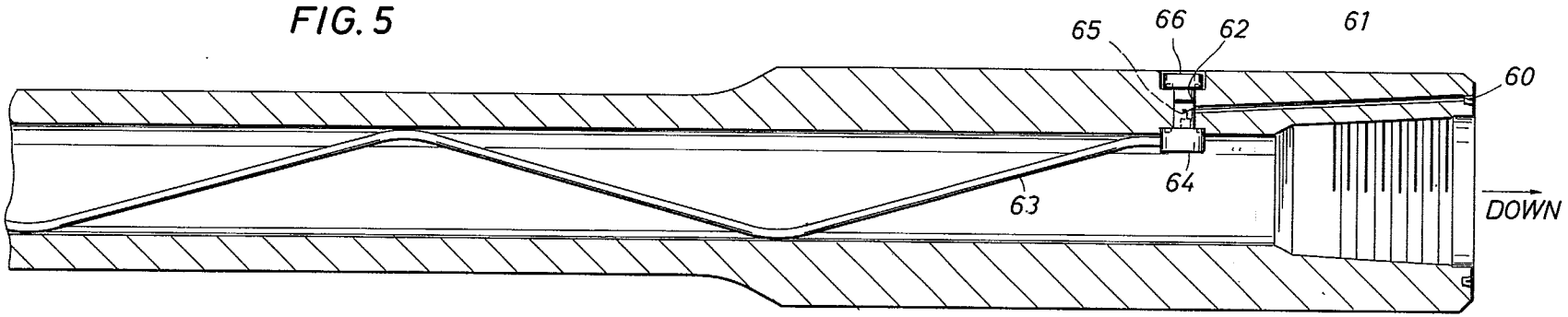

The kelly is shown in FIGS. 4 and 5, and differs from the standard kelly in that it is provided with a box joint at both ends instead of the more conventional box and pin joints. This allows the use of a larger kelly bore to accept the wire-carrying conduit. A 5¼ inch hex kelly with a 3¼ inch bore and an NC 46 box down has been successfully used. The same size kelly could also be used with a more conventional NC 50 pin down. This would eliminate the need for a double pin saver sub. The sealing shoulder at the lower end of the kelly is provided with an annular groove and contact ring assembly 60. The annular groove communicates with a port 62 formed in the wall of the kelly by means of a passageway 61. The port 62 serves to provide a means for positioning the conduit anchor 64, which has the same construction as described above with respect to the conduit anchor used in the saver sub. The conduit 63 in the kelly is provided with a helical shape so that its outer surface is forced into conact with the inner surface of the kelly. This insures that the conduit remains in place and does not obstruct the bore of the kelly. In the 42-foot long, 5¼ inch kelly with a 3¼ inch bore, a ¾ inch O.D. × 0.095 inch wall conduit with eleven counter-clockwise or left-hand coils has been shown to work well. The electrical conductor disposed in the conduit, and the pigtail from the contact ring are joined at 65 in the port 62. The conduit anchor 64 is held in position by a cap screw 66 which threads into the conduit anchor in much the same way as described above with respect to the saver sub of FIG. 2. The other end of the conduit is anchored in the port 67 in the same manner. The electrical conductor is led out through a passageway 70 that communicates with the interior of the port 67. Afterwards the electrical conductor couples to the slip ring assembly, shown in FIG. 1 which may be a commercial slip-ring assembly, manufactured by Instrument Engineering Company, Austin, Texas.

From the above description, it is seen that the invention provides a means by which the electrical circuit disclosed in U.S. Pat. No. 3,696,332 may be extended through the surface equipment to a slip ring assembly mounted on or above the kelly. The invention does not obstruct or otherwise interfere with the operation of the lower kelly cock, nor does it obstruct the bore of either the kelly, kelly cock, or the saver sub. Thus, conventional wireline tools and other equipment may be run through the kelly, kelly cock, and saver sub in a conventional manner. The invention utilizes the contact ring assemblies located in the sealing shoulders of mating members, as disclosed in the referred patent.

I claim as my invention:

1. A kelly cock for use with a drill string that includes a hard-wired telemetering system, said telemetering system terminating at the upper end of the drill string in an annular contact ring disposed in the sealing shoulder of the tool joint on said drill string; said kelly cock comprising:

first and second tubular members, said first tubular member having a pin joint at one end and said second tubular member having a box joint at one end, the other ends of said first and second tubular members having parallel non-sealing shoulders, said first and second tubular members being joined together; a valve means, said valve means being disposed between said first and second tubular members and held in place when said first and second tubular members are jointed together;

an annular groove formed in the sealing shoulder of both the pin end of said one tubular member the box end of said second tubular member and both of said parallel non-sealing shoulders;

a plurality of contact rigns, one of said contact rings being disposed in each annular groove of each of said tubular members, each of said contact rings having a pigtail;

a passageway formed in the wall of said first and second tubular members, said passageway communicating at opposite ends with the annular grooves in said first and second tubular members, the pigtails of each contact ring extruding into one of said passageway; and a port opening formed in each of said tubular members, said ports communicating with the passageways formed in said tubular members and removable means for closing said ports whereby said pigtails may be connected adjacent said ports and replaced in said passageways.

2. The kelly cock of claim 1, and in addition, sealing means disposed between the non-sealing shoulders of said first and second tubular members to isolate said contact rings from any fluids.

3. A kelly for use with a drill string having a hard wired telemetering system, said kelly comprising:

a kelly, said kelly having an annular groove formed in its sealing shoulder at its lower end;

a first port opening formed in the wall of said kelly adjacent said lower end;

a passageway formed in the wall of said kelly to provide communication between said annular groove and said port;

a second port opening formed in said kelly adjacent the upper end of said kelly;

a conduit, said conduit having a helical form whose outer diameter substantially equals the inner diameter of said kelly, said conduit extending between said first and second port openings, the ends of said conduit being both sealed and anchored in said port openings;

a contact ring positioned in said annular groove; and an electrical conductor extending from said contact ring through said passageway and conduit and extending out said second port opening.

4. The kelly of claim 3, and in addition, a slip ring assembly, said slip ring being disposed adjacent the upper end of said kelly and said electrical conductor being coupled to the said slip ring assembly.

5. The kelly of claim 4, and in addition, said electrical conductor comprising an electrical pigtail attached to said contact ring and extending through said passageway to said first port opening, an electrical cable extending through said conduit, said pigtail and cable being joined in said first port opening, and removable means for closing the outer end of said first port opening.

6. A saver sub for use with a hard-wired drill string telemetry system comprising:

a tubular member having a sealing shoulder formed on each end;

an annular groove formed in each sealing shoulder;

a pair of contact rings, one of said contact rings being disposed in each annular groove;

a pair of port openings formed in said tubular member adjacent said sealing shoulders;

passageways formed in said tubular member for connecting said annular grooves with said port openings;

anchoring and sealing means disposed in each of said port openings, said anchoring and sealing means projecting into the interior of said tubular member;

a conduit member, said conduit member being disposed within said tubular member and extending between said anchor and sealing means; and a conductor connected to said contact rings at each end and extending through said passageways, anchor means and conduit to complete an electrical circuit between said contact rings.

7. The saver sub of claim 6 and in addition each of said anchor and sealing means comprising a member having an enlarged end and a reduced neck portion, said neck portion extending into said port opening; securing means for securing said anchor means in said port opening and sealing said enlarged end to the inner surface of said tubular member, said conduit extending between said enlarged ends and communicating with a passageway formed in said anchor means.

8. The saver sub of claim 7 and in addition each of said contact rings having a pigtail, said pigtail extending through the passageways formed in said tubular member and being connected to the conductor that extends through said conduit.

* * * * *